US005160551A

United States Patent [19]

Rein et al.

[11] Patent Number: 5,160,551

[45] Date of Patent: Nov. 3, 1992

[54] ACTIVATOR FOR USE IN PHOSPHATING PROCESSES

[75] Inventors: Rüdiger Rein, Breidenbach; Dieter Jentsch, Langen; Kalus-Werner Wittel, Frankfurt am Main, all of Fed. Rep. of Germany

[73] Assignee: Metallgesellschaft Aktiengesellschaft, Frankfurt am Main, Fed. Rep. of Germany

[21] Appl. No.: 686,825

[22] Filed: Apr. 17, 1991

[30] Foreign Application Priority Data

Apr. 21, 1990 [DE] Fed. Rep. of Germany ..... 4012795

[51] Int. Cl.[5] ..... C23C 22/00

[52] U.S. Cl. ..... 148/254; 148/262

[58] Field of Search ..... 148/254

[56] References Cited

U.S. PATENT DOCUMENTS

| | | | |
|---|---|---|---|
| 2,097,211 | 10/1937 | Davis | 148/254 |
| 2,329,065 | 9/1943 | Lum | 148/254 |
| 3,166,444 | 1/1965 | Ehren | 148/254 |
| 3,813,302 | 5/1974 | Morrison . | |
| 5,039,362 | 8/1991 | Brands | 148/254 |

FOREIGN PATENT DOCUMENTS 55-91997 7/1980 Japan .

*Primary Examiner*—Sam Silverberg

*Attorney, Agent, or Firm*—Herbert Dubno; Jonathan Myers

[57] ABSTRACT

The activating agent which is based on titanium(IV) phosphate and intended for use in the activation of metal surfaces before a zinc phosphating treatment contains one or more copper compounds and has a Ti:Cu weight ratio of 1:100 to 60:1 and optionally contains in addition at least one of the components consisting of condensed phosphate, silicate, complexing agent, water-soluble organic polymer, thickening agent, and surfactant. It is used to prepare aqueous activating baths for activating iron, steel, galvanized steel, zinc alloy-plated steel, aluminum-plated steel and aluminum before a zinc phosphating treatment, which baths contain 0.001 to 0.060 g/l Ti, 0.020 to 1.2 g/l orthophosphate (calculated as $P_2O_5$), and 0.001 to 0.1 g/l Cu and so much alkali that the bath has a pH value of 7 to 11, preferably of 7.5 to 10.

11 Claims, No Drawings

ACTIVATOR FOR USE IN PHOSPHATING PROCESSES

CROSS REFERENCE TO RELATED APPLICATION

This application is related to the concurrently filed copending application Ser. No. 07/686,800 filed Apr. 17, 1991.

FIELD OF THE INVENTION

Our present invention relates to an activating agent which is based on titanium (IV) phosphate and is intended for use in the activation of metal surfaces before a zinc phosphating treatment. The invention also relates to a phosphating method in which the activator is used to prepare activating baths.

BACKGROUND OF THE INVENTION

Zinc phosphate layers can be formed on various metal surfaces, e.g. iron, steel, zinc alloy plated steel, aluminum or aluminum-plated steel by a phosphating treatment with aqueous solutions based on zinc phosphate. In addition to zinc and phosphoric acid, the phosphating solution may contain other cations and anions and the solutions are applied by spraying, dipping or spraying and dipping. The resulting zinc phosphate coatings afford protection against corrosion, improve the adhesion of paint, reduce sliding friction, facilitate cold working and provide electrical insulation.

In addition to the phosphating treatment proper a phosphating process includes various pretreating and after-treating stages. It is essential to clean the metal surfaces. This is generally effected by means of alkaline or acid cleaners and has the result that oils, greases, oxides and adhering solid particles are removed from the metal surface. If cleaning is effected by means of mild alkaline cleaners, it will be possible, in principle, to combine the cleaning with the activation of the metal surface. But the activation is suitably effected in a separate process step after the cleaning.

By the activation of the metal surface it is desired to ensure that a zinc phosphate layer which is as finely crystalline as possible will be formed in the shortest possible phosphating time. For this reason a criterion of the effect of the activating agent is the minimum phosphating time. The ability to form even finely crystalline zinc phosphate coatings can be determined from the weight of the layer or from micrographs prepared by a scanning electron microscope.

Activating agents based on titanium(IV) phosphate have proved particularly satisfactory in practice. Titanium(IV) phosphates will be formed by the reaction of aqueous solutions of titanium(IV) salts with soluble phosphates or phosphoric acid. But products having activating properties will be obtained only under special production conditions, which have been described, for example, in U.S. Pat. Nos. 2,310,239 and 2,456,947, which contain exact information regarding the nature and concentration of the raw material, temperature and pH value range during the production. Even if constant reaction conditions are maintained, however, the action in application technology will fluctuate from charge to charge.

A disadvantage involved in the use of activating agents based on titanium(IV) phosphate is that deionized water must be used to prepare the activating baths because the activating baths will be destabilized by alkaline earth metal ions which are contained in tap water and contribute to its hardness. Such alkaline earth metal ions may also be introduced into the activating bath by spent rinsing water.

In order to avoid the detrimental action of alkaline earth metal ions and thus to avoid a destabilization of the activating bath it has been proposed in DE-A-37 31089 to admix cation-exchanging zeolites having a primary particle diameter below 3 μm to the activating titanium phosphate. Alternatively the activating baths may be improved in that, as described in EP-8-180523, phosphonic acid as a complexing agent is added to the activating bath so that industrial waste water may be used to prepare the bath. Besides, the presence of phosphonic acid allegedly causes the zinc phosphate coating to have an extremely fine crystallinity. Various phosphonic acids, however, have the severe disadvantage that they will poison the phosphating baths even in concentrations of a few mg/l and phosphonic acid introduced into the phosphating bath from the activating bath may render the phosphating bath unusable within a very short time.

In accordance with DE-A-38 14 28 poly(aldehydecarboxylic acids) in substoichiometric amounts are added as complexing agents for titanium(IV) during the preparation of activating titanium(IV) phosphates so that titanium phosphates having a small particle size (below 200 μm) will mainly be formed and allegedly increase the activity of the activating agent. In that case too an introduction of the poly(aldehydecarboxylic acids) into the phosphating bath may involve considerable disadvantages.

The possibility to improve the stability of the activating baths against the hardness of water by suitable additives and the possibility to improve the quality as is reflected by the service life of the activating baths and by the crystallinity of the zinc phosphate coating formed in the succeeding stage by the use of complexing agents has been discussed previously. However, considerable disadvantages are involved in the measures by which said improvements can be achieved. On disadvantages, which is particularly involved in the use of complexing agents, is that they will poison the phosphating bath and will render the treatment of the waste water more difficult because they cause heavy metals to be dissolved or to be kept in solution.

OBJECTS OF THE INVENTION

It is an object of the invention to provide an activating agent which is based on titanium(IV) phosphate and can be used in the activation of metal surfaces before a zinc phosphating treatment, which is free from the disadvantages of the known activating agents, and which can simply be produced and when used to prepare activating baths will result in stable activating baths which have a long service life.

Another object is to provide an improved activating agent which will ensure that finely crystalline zinc phosphate coatings will be formed within a short time.

Still another object is to provide an improved phosphating method.

DESCRIPTION OF THE INVENTION

These objects and others which will become apparent hereinafter are attained with an activating agent containing Ti(IV) phosphate and one or more copper compounds and has a Ti:Cu weight ratio from 1:100 to 60:1.

The copper content is adjusted by an addition of copper compounds which will cause the minimum phosphating time to be very considerably decreased. Another result of the addition of copper is that the activating bath is stable over a wide temperature range and has very good activating properties.

Substantially all compounds of copper may be used to introduce copper into the activating agent. In accordance with a further feature of the invention the activating agent contains copper compounds which have been introduced as copper hydroxide, copper oxide hydrate, copper tartrate, copper nitrate and/or copper phosphate. While copper sulfate or copper chloride may be used, they are not preferred.

In accordance with a further feature of the invention an activating agent is provided which additionally contains at least one of the components consisting of condensed phosphates, silicates, complexing agents, water-soluble organic polymers, thickening agents and surfactants. When an activating agent containing such further additives is used in an activating bath, a number of additional desirable properties will be obtained.

For instance, an addition of condensed phosphate to the activating agent will have the result that the activating bath prepared therefrom will be less susceptible to hardness-imparting elements which have been introduced. Water-soluble organic polymer will stabilize colloidal titanium(IV) phosphate which has been dispersed in the activating bath and will thus considerably prolong the service life of the activating bath. Surfactants will decrease the surface tension so that the activating titanium phosphate will adhere more strongly to the metal surface.

In accordance with a further feature of the invention the activating agent contains 0.1 to 4% by weight titanium phosphate (calculated as Ti).

In the preparation of aqueous activating baths for use in the activation of iron, steel, galvanized steel, zinc alloy-plated steel, aluminized steel, and aluminum before a zinc phosphating treatment, the activating agent is used in such a manner that the resulting activating bath will contain 0.001 to 0.060 g/l Ti, 0.020 to 1.2 g/l orthophosphate (calculated as $P_2O_5$), and 0.001 to 0.1 g/l Cu and will have a pH value from 7 to 11, preferably from 7.5 to 10.

Copper concentrations in excess of 0.1 g/l are to be avoided because they may be disturbing in the phosphating treatment carried out in the subsequent stage.

Thus the invention can also include an activating agent which additionally contains at least one condensed phosphate, silicate, complexing agent, water-soluble organic polymer, thickening agent or surfactant in an activating bath which contains the above-mentioned compounds in the following amounts:

up to 1.2 g/l condensed phosphate (calculated as $P_2O_5$)

up to 0.5 g/l silicate (calculated as $SiO_2$)

up to 1.0 g/l complexing agent, up to 0.1 g/l water-soluble organic polymer, up to 0.1 g/l thickening agent, and up to 0.3 g/l surfactant.

It is possible to incorporate the activating agents into aqueous alkaline cleaners ready for use or into liquid aqueous or solid concentrates, which are used to formulate the aqueous alkaline cleaning bath. Due to the ease of dilution preparation of aqueous cleaner/activating agent concentrate is particularly advantageous.

The aqueous cleaner or the cleaner concentrate is prepared by dissolution or mixing one or more compounds selected from the group which consists of carbonates, silicates, phosphates, borates, hydroxides, hydroxycarboxylic acids and organic polymers, such as sodium hydrogencarbonate ($NaHCO_3$), sodium carbonate ($Na_2CO_3$), sodium metasilicate ($Na_2SiO_3$), sodium disilicate ($Na_2Si_2O_5$), sodium waterglass, disodium phosphate ($Na_2HPO_4$), sodium tripolyphosphate ($Na_5P_3O_{10}$), borax ($Na_2B_4O_7x10H_2O$), sodium hydroxide, sodium gluconate, sodium heptonate, sodium citrate, the trisodium salt of nitrilo-triacetic acid, condensation products of phenolsulfonic acid or naphthalene sulfonic acid with formaldehyde or—because of the better solubility in water—the corresponding potassium compounds.

The aqueous alkaline cleaners and the alkaline cleaner concentrates respectively usually contain surfactants. Suitable surfactants can be of the anionic or nonionic type such as sodium alkylbenzenesulfonate, sodium alkylsulfonate, alkylphenolpolyethylenglycolether, alkylphenolpolyethylenglycol-polypropylenglycolether, alkylpolyethylenglycolether, alkylamin polyethylenglycol compounds or block copolymers of ethylenoxide and propylenoxide. In using aqueous liquid cleaner concentrates the content of surfactants is about 0.5 to 10%, preferably 0.5 to 4% by weight.

In order to avoid sedimentation of insoluble, coarsely dispersed particles—if any—of the activating agent in an aqueous activating cleaner concentrate and to prevent phase segregation of surfactants of the concentrates due to a salting out effect it is advantageous to add thickening agents which can be selected from the group consisting of natural polymers. Suitable polymers are e.g. polypeptides, such as gelatine, or polysaccharides, such as starch, xanthane and dextrin. In preparing concentrates of that type it is advantageous to completely dissolve at first the polymer in water and thereafter the other components of the cleaner. In a succeeding step the surfactants are dissolved or finely dispersed by vigorous stirring. At the end of preparation the activating agent is added. If composed in an appropriate way the liquid activating cleaner concentrate has a shelf life of several months at 0° to 35° C. and is pumpable.

With respect to the solubility of the constituents, the mode of preparation and the expenses of packing and shipment it is particularly advantageous to prepare a concentrate containing 50 to 90%, preferably 60 to 75% water.

SPECIFIC EXAMPLES

The invention will be explained in greater detail in the following Examples.

EXAMPLE 1

Grade St 1405 steel sheets were treated in the following procedure:

1. Cleaning—Dipping into a highly alkaline cleaner; 20 g/l; 10 minutes; 70° C.;
2. Rinsing—Cold water; 30 seconds;
3. Cleaning—Dipping into a weakly alkaline cleaner; 13 g/l; 5 minutes; 60° C.;
4. Rinsing—Cold water, 30 minutes;
5. Activating—Pretreatment 1 g/l activating agent; dipping for 30 seconds; 22° C.;

6. Phosphating—1.2 g/l Zn; 12.0 g/l $P_2O_5$; 0.8 g/l Mn; 0.8 g/l Ni; 7 g/l $NO_3$; 4.07 g/l Na; 0.17 g/l $NaNO_2$; 50° C.; phosphating times 3 and 6 minutes; dipping;
7. Rinsing—Cold water, 30 seconds;
8. Drying—With hot air.

A total of 6 activating agents were produced and were used to prepare respective activating baths.

Activating Agent 1

To produce the activating agent in accordance with the invention, 3.27 kg solid sodium hydroxide were dissolved in 4.9 kg water and when the solution had cooled down a solution of 0.54 kg $H_2TiF_6$ (40% by weight), and 0.97 kg $Ca(NO_3)_2 \times 4\ H_2O$ in 4.36 kg water was added thereto. When the resulting slurry had cooled down, a solution of 4.91 kg $H_3PO_4$ (55% by weight $P_2O_5$) in 0.46 kg water was added thereto in such a manner that the temperature did not rise above 45° C. When the addition of phosphoric acid had been completed, the temperature was heated slowly to 70° to 90° C. That temperature was maintained for 30 minutes in order to bring the activating agent to maturity. Thereafter an aqueous solution of 216.67 g $Cu(NO_3)_2 \times 3H_2O$ was homogeneously distributed in the slurry and the slurry was dried. All mixing operations and the maturing treatment were performed with stirring.

Activating Agent 1a

An activating agent was produced by the procedure which has been described for the activating agent 1 but without an addition of copper nitrate.

Activating Agent 2

To produce the activating agent, 50 kg titanyl sulfate, 375 kg NaOH (solid), 580 kg phosphoric acid (55% by weight $P_2O_5$), 159 kg $Na_2CO_3$ (solid) and 170 kg water were mixed with kneading and copper phosphate in such an amount was subsequently added thereto that a copper concentration of 2% by weight was obtained.

Activating Agent 2a

An activating agent was produced which had the same composition as Activating Agent 2 but did not contain copper phosphate.

Activating Agent 3

To produce the Activating Agent 3, so much maleic acid anhydride copolymer was added to Activating Agent 1 that the resulting activating bath contained 10 mg/l of said polymer.

Activating Agent 4

This was also produced from Activating Agent 1, to which a surfactant was admixed in such amounts that the activating bath which was subsequently prepared had a surfactant concentration of 0.3 g/l.

The coverage provided by the coating was determined after phosphating times of 3 minutes and 6 minutes. The coverage indicates the proportion in which the area of the metal surface is provided with a closed zinc phosphate coating. The evaluation was made as a result of visual inspection. The weight of the phosphate coating was determined by gravimetry and the minimum phosphating times were determined. The minimum phosphating time is the minimum time that is required to form a closed phosphate coating. The crystallinity of the phosphate coatings was determined from scanning electron microscope micrographs at a magnification of 2000.

The results which were determined in each case as regards the coverage of the metal surface after phosphating times of 3 and 6 minutes, respectively, the minimum phosphating time, the weight of the coating and the service life of the phosphating baths in days have been compiled in the following table.

| Activating Agent | Cu in activating agent | Coverage after 3 min | Coverage after 6 min | Minimum phosphating time (min.) | Coating weight ($g/m^2$) | Service life days |
|---|---|---|---|---|---|---|
| 1 | 0.01 | 90–100 | 100 | 4 | 2.7 | 14–21 |
| 1a | — | 60–70 | 100 | 6 | 3.2 | 14–21 |
| 2 | 0.02 | 95–100 | 100 | 3.5 | 3.3 | 10 |
| 2a | — | 50–60 | 100 | 6 | 3.7 | 2 |
| 3 | 0.01 | 90–100 | 100 | 4 | 3.3 | 21–30 |
| 4 | 0.01 | 90–100 | 100 | 4 | 3.0 | 30 |

From the foregoing table it is particularly apparent that the use of the activating agent in accordance with the invention as exemplified in Examples 1, 2, 3, and 4 will result in a high and almost complete coverage of the metal surface even after a phosphating time of only 3 minutes and will permit short treating times to be employed in the succeeding phosphating stage. The weight of the phosphate layer is well within the usual range.

The results obtained with the use of Activating Agents 3 and 4 indicate that the addition of the maleic acid anhydride copolymer and of a surfactant will result in a considerable increase of the service life of the activating bath at short minimum phosphating times (compare with Activating Agent 1). The examination conducted with the scanning electron microscope revealed that the phosphate layers formed where the activating agents in accordance with the invention had been used were fine-grained.

We claim:

1. An activating composition including an activating agent for the activation of metal surfaces before a zinc phosphating treatment, comprising titanium(IV) phosphate and further containing at least one copper compound, said activating agent having a Ti:Cu weight ratio of 1:100 to 60:1 where in said composition contains 0.001 to 0.060 g/l Ti 0.020 to 1.2 g/l/l orthophosphate (calculated as $P_2O_5$), and 0.001 to 0.1 g/l Cu and alkali in an amount that it has a PH value from 7 to 11.

2. The activating agent defined in claim 1 wherein said copper compound is selected from the group which consists of copper hydroxide, copper oxide hydrate, copper tartrate, copper nitrate, and copper phosphate.

3. The activating agent defined in claim 1, further comprising at least one condensed phosphate, silicate, complexing agent, water-soluble organic polymer, thickening agent, or surfactant.

4. The activating agent defined in claim 2 which contains 0.1 to 4% by eight titanium phosphate (calculated as Ti).

5. An activating composition according to claim 1 including an aqueous alkaline cleaner ready for use or an aqueous alkaline or solid cleaner concentrate.

6. The use defined in claim 5 wherein said pH value is 7.5 to 10.

7. The activating composition according to claim 3 which contains:

up to 1.2 g/l condensed phosphate (calculated as $P_2O_5$)
up to 0.5 g/l silicate (calculated as $SiO_2$)
up to 1.0 g/l complexing agent,
up to 0.1 g/l water-soluble organic polymer,
up to 0.1 g/l thickening agent, and
up to 0.3 g/l surfactant.

8. A phosphating method which comprises the steps of:

(a) forming an aqueous activating solution which contains
0.001 to 0.060 g/l Ti,
0.020 to 1.2 g/l orthophosphate (calculated as $P_2O_5$), and
0.001 to 0.1 g/l Cu
and alkali in an amount, that it has a pH value from 7 to 11;

(b) treating a metal surface with said aqueous activating solution; and (c) subjecting said metal surface to contact with a zinc phosphating bath.

9. The method defined in claim 8 wherein said solution contains up to 1.2 g/l condensed phosphate (calculated as $P_2O_5$)
up to 0.5 g/l silicate (calculated as $SiO_2$)
up to 1.0 g/l complexing agent,
up to 0.1 g/l water-soluble organic polymer,
up to 0.1 g/l thickening agent, and
up to 0.3 g/l surfactant.

10. The method defined in claim 8 wherein the pH value of said solution is adjusted to 7.5 to 10.

11. The composition in claim 1 wherein the metal surface is iron, steel galvanized steel, zinc alloy-plated steel, aluminum-plated steel or aluminum.

* * * * *